US010703550B2

(12) United States Patent
Onesti

(10) Patent No.: US 10,703,550 B2
(45) Date of Patent: Jul. 7, 2020

(54) DISPENSING SYSTEM FOR FLEXIBLE CONTAINERS SUCH AS POUCHES, SACHETS, PACKETS OR BAG-IN-BOXES

(71) Applicants: Mirco Onesti, Milan (MI) (IT); Alice Tacconi, Milan (MI) (IT)

(72) Inventor: Mirco Onesti, Milan (IT)

(73) Assignee: MIRCO ONESTI, Milan (MI) (IT)

( * ) Notice: Subject to any disclaimer, the term of this patent is extended or adjusted under 35 U.S.C. 154(b) by 0 days.

(21) Appl. No.: 15/302,916

(22) PCT Filed: Apr. 1, 2015

(86) PCT No.: PCT/IB2015/052386

§ 371 (c)(1),
(2) Date: Oct. 7, 2016

(87) PCT Pub. No.: WO2015/155634

PCT Pub. Date: Oct. 15, 2015

(65) Prior Publication Data

US 2017/0029192 A1 Feb. 2, 2017

(30) Foreign Application Priority Data

Apr. 9, 2014 (IT) ..... VI2014A0100

(51) Int. Cl.
*B65D 77/06* (2006.01)
*B65D 75/52* (2006.01)

(52) U.S. Cl.
CPC ..... *B65D 77/065* (2013.01); *B65D 75/525* (2013.01)

(58) Field of Classification Search
CPC ..... B65D 77/065; B65D 75/525
(Continued)

(56) References Cited

U.S. PATENT DOCUMENTS 3,684,156 A * 8/1972 Fettinger ..... B65D 75/525 206/216
5,649,643 A * 7/1997 Ridgeway ..... A47K 5/12 222/105

(Continued)

FOREIGN PATENT DOCUMENTS

DE 9408454 U1 * 7/1994 ..... B65D 75/008
FR 2587978 B1 10/1988

(Continued)

*Primary Examiner* — Jeremy Carroll
(74) *Attorney, Agent, or Firm* — Robert S. Lelkes

(57) ABSTRACT

The invention is a dispensing system (1; 101) suited to dispense a product (W), comprising a flexible container (2) defining a volume (Y) for containing the product (W), the flexible container (2; 102) being of the type comprising at least one dispensing opening (6; 106) and at least one collapsible and/or deformable portion suited to reduce the volume (V) in such a way as to cause the product (W) to be dispensed through the dispensing opening (6; 106). Said system comprises covering means (3; 103) externally associated with the flexible container (2; 102), the covering means (3; 103) comprising at least one shaped opening (21*a*, 21*b*; 22*a*, 22*b*; 121*a*) suited to make the flexible container (2; 102) visible and suited to provide the dispensing system (1; 101) with a decorative element as desired. The invention concerns also covering means (3; 103) suited to be externally associated with a flexible container (2; 102) that defines a volume (V) for containing a product (W).

14 Claims, 7 Drawing Sheets

(58) Field of Classification Search
USPC ..... 222/105, 175
See application file for complete search history.

(56) References Cited

U.S. PATENT DOCUMENTS

| | | | | |
|---|---|---|---|---|
| 6,811,057 | B2 * | 11/2004 | Duquet | B65D 75/38 222/105 |
| 7,669,736 | B2 * | 3/2010 | Harper | B65D 75/525 222/105 |
| 8,459,503 | B2 * | 6/2013 | Groesbeck | B65D 5/4204 220/592.01 |
| 2003/0192909 | A1 * | 10/2003 | Maskell | B65D 35/28 222/103 |
| 2008/0277417 | A1 * | 11/2008 | Groesbeck | B65D 5/4204 222/105 |
| 2009/0078721 | A1 * | 3/2009 | Hoffman | B65D 77/06 222/1 |
| 2016/0023835 | A1 * | 1/2016 | El-Afandi | B65D 81/34 426/87 |

FOREIGN PATENT DOCUMENTS

| | | | | |
|---|---|---|---|---|
| JP | H0977135 | A | 3/1997 | |
| JP | WO 2013054411 | A1 * | 4/2013 | B65D 75/525 |
| WO | 2013054411 | A1 | 4/2013 | |

* cited by examiner

DISPENSING SYSTEM FOR FLEXIBLE CONTAINERS SUCH AS POUCHES, SACHETS, PACKETS OR BAG-IN-BOXES

CROSS-REFERENCE TO RELATED APPLICATIONS

This patent application is the U.S. national phase of PCT international patent application no. PCT/IB2015/052386 filed on Apr. 1, 2015, which claims priority from Italian patent application no. VI2014A000100 filed on Apr. 9, 2014.

TECHNICAL FIELD OF THE INVENTION

The present invention concerns the technical field of product dispensing systems.

In particular, the present invention concerns a dispensing system for flexible containers such as pouches, sachets, packets or bag-in-boxes, containing preferably fluid products.

DESCRIPTION OF THE STATE OF THE ART

In the field of product dispensing systems, preferably for products in fluid form, the use of dispensing devices is known, which are constituted by collapsible/deformable containers commonly known as pouches, sachets, packets or bag-in-boxes. The product is dispensed through a special opening provided in the container following the deformation of the container itself caused by the pressure exerted by the user's hand.

In some kinds of container of the known type, after the exertion of pressure and the subsequent outflow of product the container remains in its deformed condition. In other kinds of container of the known type, after the exertion of pressure and the outflow of product the container substantially returns to its original initial shape.

The collapsible/deformable containers having the characteristics described above are referred to as flexible containers in the following description.

A flexible container generally comprises at least one external part that is at least partially flexible and can be collapsed/deformed in order to reduce the volume enclosed by the container in such a way as to simultaneously convey the product from the inside of the container towards a dispensing opening.

In this regard, the containers are typically made of plastic or coupled materials that ensure the required characteristics in terms of collapsibility and/or deformability. Said containers are preferably made with a closed plastic film having a given thickness, in order to substantially form a bag.

Furthermore, these types of container are of the disposable and/or reusable type, depending on the needs.

Depending on the specific field of application, the product held in the container can be of various types. Said product is preferably constituted by a fluid. In this way, for example, the product can be constituted by a drink, such as a liquid, a gel etc. An example of the above concerns, for example, sports drinks.

In other cases the product can be intended for several other uses. Typical sectors in which flexible containers are used include, for example, the sector of bathroom cleaning, glass cleaning, kitchen oven cleaning, furniture cleaning or the sector of soap or shampoo dispensers, or the sectors of face, hand, hair, skin care products, shaving foams, or even of animal care products, for example cat and dog care products.

In other cases the product can be constituted by powders and/or solid products, for example detergents in powder, in microgranules, or other products such as snacks, chips etc.

The containers of the known type can be provided with a neck to which a closing cap is applied, wherein said cap is properly removed when the product must be dispensed.

However, the dispensing systems according to the state of the art and constituted by flexible containers pose some drawbacks.

A first drawback of the flexible containers of the known type lies in that it is difficult and/or expensive to customize the container.

Customizing the container is a determinant factor to ensure that the container has the aesthetic appearance and/or the shape desired by the manufacturer. A first important aspect, in fact, concerns the aesthetic appearance of the container that distinguishes the type of product and/or the origin of the product, in particular the manufacturer's brand. Also the colours used on the container are a determinant factor to catch the attention of the purchaser/user.

Another important aspect concerns the shape of the container, in particular from the point of view of ergonomics.

The customization of the container according to the known technique typically takes place through direct shaping of the container and/or through an expensive graphic customization made directly on the external surface of the container. This involves high costs and dedicated production technologies.

The flexible containers of the known type, therefore, offer scarce ergonomic features or no ergonomic features at all, which makes them uncomfortable to handle and to hold during use.

Furthermore, the flexible containers of the known type are not easy to store and sometimes require the use of a further casing for packaging purposes.

Another drawback of the flexible containers of the known type is constituted by their scarce stability or total instability, both in their initial configuration before use and after successive dispensing operations.

Furthermore, as a consequence of said dispensing operations, the container is subjected to an evident aesthetic and/or structural deterioration caused by the deformation of the container that becomes emptier and emptier. In particular, any logos and/or writings on the outside of the container may become unidentifiable and/or illegible.

The state of the art further comprises dispensing systems known from patent documents WO 2013/054411 A1, DE 94 08 454 U1, and JP H09 77135 A.

Therefore, the above clearly shows that there is the need to identify alternative solutions that are more functional than the known ones.

It is the main object of the present invention, therefore, to resolve or at least partially overcome the problems that are typical of the solutions known in the art.

In particular, it is a first object of the invention to provide a dispensing system for flexible containers that allows an easy and economical customization, in order to give the system a high aesthetical value and/or improved ergonomic features.

It is another object of the invention to provide a dispensing system for flexible containers that makes it possible to obtain more stability.

It is a further object of the invention to provide a dispensing system for flexible containers that makes it possible to maintain the outside of the container as visible and sound as possible during all the steps of use of the container, even until it is completely empty.

It is another object of the invention to provide a dispensing system for flexible containers that makes it possible to reduce production times and/or costs.

SUMMARY OF THE INVENTION

The present invention is based on the general consideration that it is possible to provide a system for dispensing a product comprising a flexible container and an external covering element with at least one shaped opening that improves its aesthetic appearance and/or its ergonomic features.

A further general consideration on which the present invention is based is related to the fact that it is possible to provide a system for dispensing a product comprising a flexible container and an external covering element, wherein the external covering element maintains its aesthetic characteristics and its handiness also after successive product dispensing operations, even until it is completely empty.

According to a first aspect of the invention, therefore, the subject of the same is a system for dispensing a product comprising a flexible container that defines a volume suited to contain said product, said flexible container being of the type comprising at least one dispensing opening and at least one collapsible and/or deformable portion suited to reduce said volume in order to cause said product to be dispensed through said dispensing opening, wherein the dispensing system comprises covering means externally associated with said flexible container, said covering means comprising at least one shaped opening suited to make said flexible container visible and suited to provide said dispensing system with desired decorative features.

Preferably, the covering means comprise at least one base portion suited to allow the dispensing system to firmly rest on a supporting surface.

Preferably, the covering means comprise at least one external area to which graphic elements are applied, preferably information on the origin and composition of the product, brands and/or logos and/or instructions for use.

In a preferred embodiment of the invention, the covering means comprise at least two lateral surfaces arranged outside the flexible container.

Preferably, the two lateral surfaces are defined on a single element folded around said flexible container. Said element is preferably constituted by a very thin element (or sheet). Advantageously, production times and/or costs are limited.

Conveniently, said at least one shaped opening is created in at least one of said two lateral surfaces.

In said preferred embodiment, the base portion is defined by an intermediate portion between the two lateral surfaces defined in the folded sheet-like element.

The system preferably comprises means for the mutual connection of the two lateral surfaces.

In a preferred embodiment of the invention, said connection means comprise at least one edge that projects from one of the two lateral surfaces and is suited to be connected to the other lateral surface.

In an alternative preferred embodiment of the invention, the covering means comprise a single lateral surface folded around the outside of the flexible container, for example a cylindrical surface.

In a preferred embodiment of the invention, the covering means are of the at least partially flexible type, comprising at least one collapsible and/or deformable portion suited to be deformed by an external pressure exerted by a user and in turn suited to deform the flexible container in order to cause the product to be dispensed.

The covering means are preferably collapsible and/or deformable over their entire geometric area.

Conveniently, the collapsible and/or deformable portion of the covering means preferably comprises a material belonging to the group consisting of: paper-based materials, synthetic materials, polymeric materials, textile materials, wooden materials, metallic materials, combinations of different materials and coupled materials. More preferably, the covering means comprise a paper-based material.

In an alternative preferred embodiment of the invention, the covering means are not collapsible and/or deformable.

In this case, to advantage, said at least one shaped opening allows access by a user who can deform the flexible container and cause the product to be dispensed.

In a preferred embodiment, the covering means are associated with the outside of the flexible container in a non-removable manner.

In a different preferred embodiment, the covering means are removable from the flexible container.

In this case, to advantage, the covering means may constitute an element that can be used more than once, while the flexible container can be of the disposable type (refill unit).

Preferably, the dispensing opening of the flexible container projects externally with respect to the covering means.

The flexible container is preferably constituted by known containers like pouches or sachets or packets.

Preferably, the flexible container is at least partially transparent.

According to a further aspect of the invention, the object of the same is constituted by covering means suited to be externally associated with a flexible container that defines a volume suited to contain a product, said flexible container being of the type comprising at least one dispensing opening and at least one collapsible and/or deformable portion suited to reduce said volume in order to cause said product to be dispensed through said dispensing opening, wherein said covering means comprise at least one shaped opening suited to make said flexible container visible and to give the desired decorative features to the dispensing system defined by said covering means and said flexible container.

BRIEF DESCRIPTION OF THE DRAWINGS

Further advantages, objects and characteristics, as well as other embodiments of the present invention, are defined in the claims and are illustrated here below through the following description with reference to the attached drawings; in the drawings, corresponding or equivalent characteristics and/or component parts of the present invention are identified by the same reference numbers. In particular, in the figures:

DETAILED DESCRIPTION OF THE INVENTION

While the following description referred to the drawings discloses specific embodiments of the present invention, it is clear that the present invention is not limited to said specific embodiments, but, rather, the specific embodiments described below clarify several aspects of the present invention, the purpose and the scope of which are defined in the claims.

The preferred examples of embodiment of the invention described below refer to dispensing systems for a liquid drink.

It is clear that the proposed solutions can be applied also to systems for other types of products, for example products that have to be dispensed in predetermined quantities through pressure exerted by the user.

Thus, for example, the product can be constituted by a drink, for example wine or a beverage, or a gel, for example in the case of energy and sports drinks.

In other cases, the product can belong to the most varied goods sectors, for example, the sector of bathroom cleaning, glass cleaning, kitchen oven cleaning, furniture cleaning or the sector of soap or shampoo dispensers, or the sectors of face, hand, hair, skin care products, shaving foams, or even of animal care products, for example cat and dog care products.

In other cases, the proposed solutions can be used for other types of products, a specific quantity of which has to be dispensed. For example, the product can be constituted by powders and/or solid products, for example detergents in powder, in microgranules, or other products such as snacks, chips etc.

A non-limiting example of embodiment of a dispensing system that is the subject of the present invention, comprising a flexible container, is illustrated in FIGS. 1 to 4.

In particular, the dispensing system, indicated as a whole by 1, comprises a flexible container 2 and a covering element 3 that is also the subject of the present invention.

Figure 3:
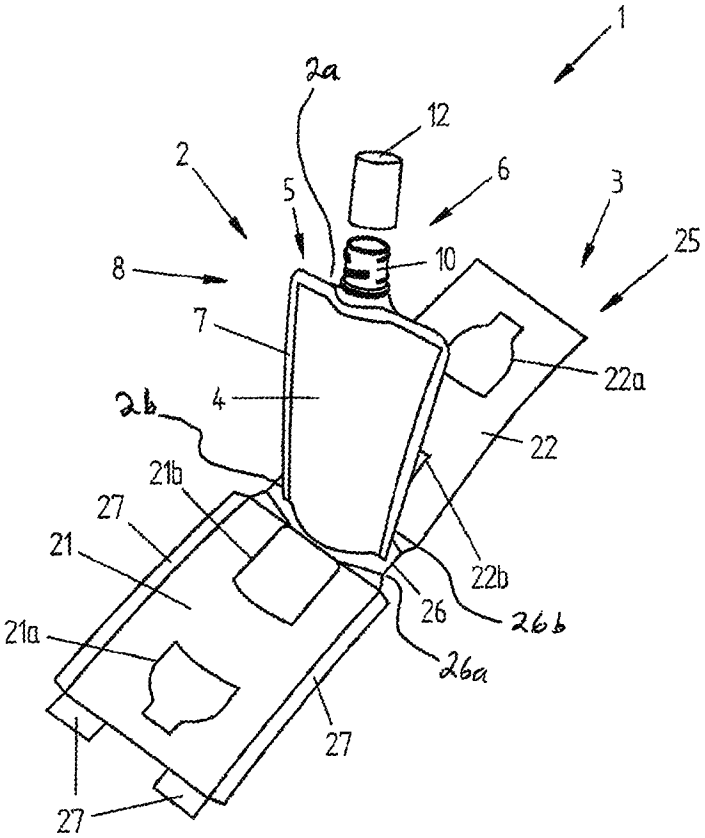
FIG. 3 shows an exploded view of the dispensing system of FIG. 1.

The flexible container 2, better visible in FIG. 3 and commonly known as pouch or sachet or packet, preferably comprises a non-rigid container, meaning a collapsible and/or deformable container, suited to define an inner volume V for containing a product W to be dispensed, in the case at hand preferably wine W. In the embodiment illustrated and described herein, the flexible container 2 is defined by external lateral walls 4, 5 that are preferably flexible over their entire geometric area. The external pressure exerted on said walls 4, 5, as is better described here below, causes the flexible container 2 to collapse/deform, which reduces the inner volume and at the same time causes the product W held therein to be dispensed, preferably through a dispensing opening 6.

More preferably, the collapsible/deformable material substantially returns to its original shape when no more external pressure is exerted on the walls 4, 5.

In variant embodiments of the invention, however, the collapsible and/or deformable material may remain in a deformed configuration as a consequence of the external pressure exerted on its walls.

In variant embodiments, furthermore, the flexible container may comprise only one partially flexible external portion that in any case can be collapsed/deformed to reduce the inner volume of the container and cause the product held therein to be dispensed.

The flexible container 2 according to the present invention, hereinafter simply referred to as container to simplify the description, thus comprises said two external lateral walls 4, 5 and preferably comprises a top end (2*a*) and a bottom end (2*b*).

The lateral walls 4, 5 that define said volume V are preferably made from a film in a plastic or plasticized material, if necessary heat-sealed along a closing edge 7.

The external shape of the lateral walls 4, 5, and therefore also of the container 2, is preferably rectangular, and simple and quick to obtain. In variant embodiments of the invention, however, the shape of the lateral walls, and therefore also of the container, can be of a different type and properly selected by the manufacturer. For example, the container may comprise several lateral walls, mixtilinear or not, or even comprise a single lateral surface, for example a cylindrical surface.

Preferably, the flexible container 2 is transparent.

The upper part 8 of the container 2 is provided with the opening 6 for dispensing the product W contained in the inner volume V. The dispensing opening 6 is preferably defined by a tubular element or neck 10, on which there is a threaded edge. Said threaded edge is suited to be coupled with a corresponding threaded profile of a closing cap 12, in such a way that the closing cap 12 can be associated with the underlying neck 10 by screwing. It is clear, however, that the dispensing opening can be made in different ways than illustrated herein, for example through an automatic opening/closing valve system.

The dispensing opening 6 advantageously projects from the outside of the covering element 3, so that it can be easily accessed by the user to dispense the product W.

According to the present invention, furthermore, the covering element 3 is associated with the outside of the container 2.

The covering element 3 preferably comprises two external lateral walls 21, 22 suited to be arranged outside the external lateral walls 4, 5 of the container 2. The external lateral walls 21, 22 are preferably joined by an intermediate connection area 26 suited to be arranged at the base of the container 2. The external lateral walls 21 and 22 are preferably joined to the intermediate connection area 26 via folds 26*a* and 26*b*, respectively.

According to a particular aspect of the present invention, the external lateral walls 21, 22 of the covering element 3 are provided with shaped openings 21*a*, 21*b*, 22*a*, 22*b*.

According to a first aspect of the dispensing system 1, the presence of said shaped openings 21*a*, 21*b*, 22*a*, 22*b* gives the system 1 itself the generic aspect of a bottle. Advantageously, the container 2, which substantially has a standard, rectangular and substantially anonymous shape, is given the eye-catching ornamental shape of a bottle, which immediately recalls the nature of the product contained therein, meaning wine W.

According to another aspect of the dispensing system 1, the presence of said shaped openings 21*a*, 21*b*, 22*a*, 22*b* allows a direct view of the container 2 and, if the latter is at least partially transparent, makes it possible to directly view the product W inside it and therefore, in particular, its filling level.

Figure 2:
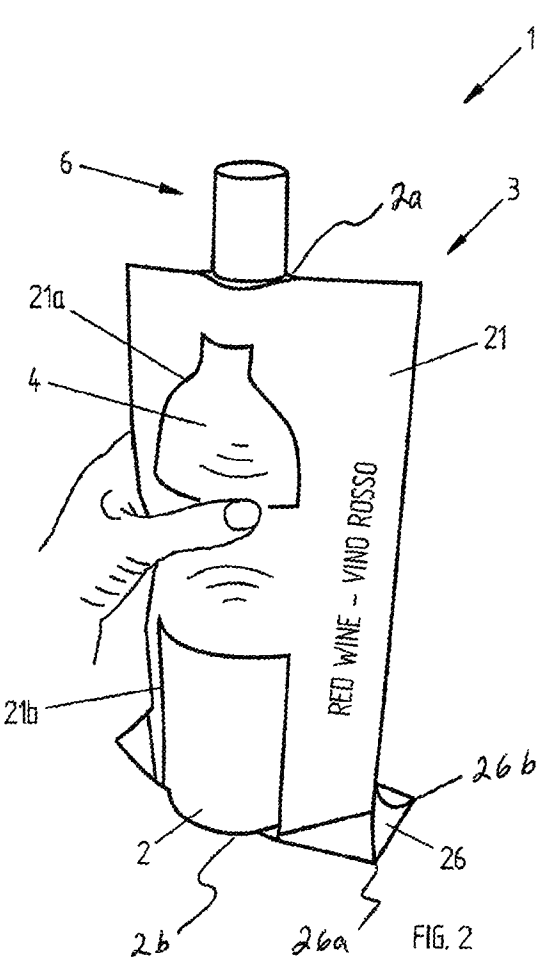
FIG. 2 shows the dispensing system of FIG. 1 during use.
Figure 1:
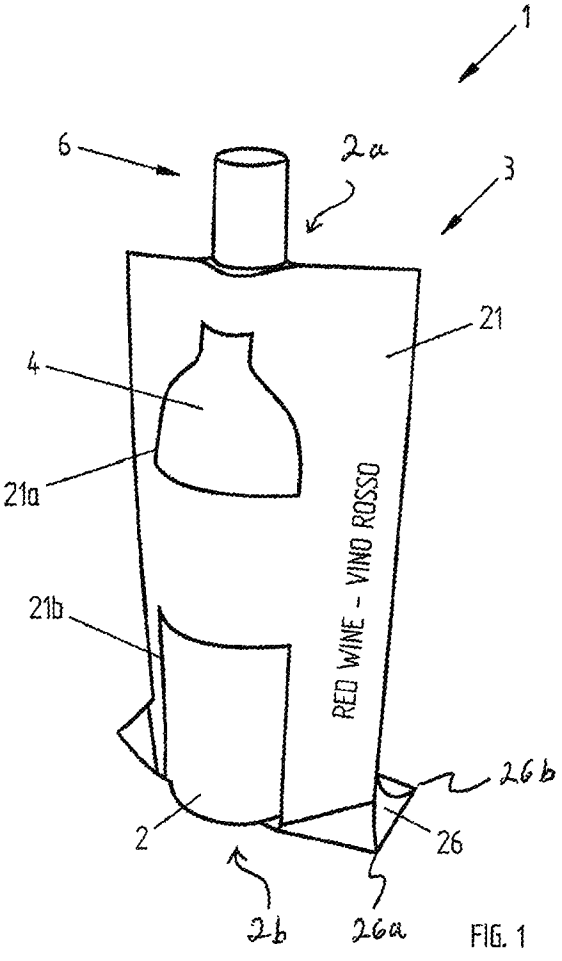
FIG. 1 shows an axonometric view of a preferred embodiment of the dispensing system that is the subject of the invention.
Figure 4:
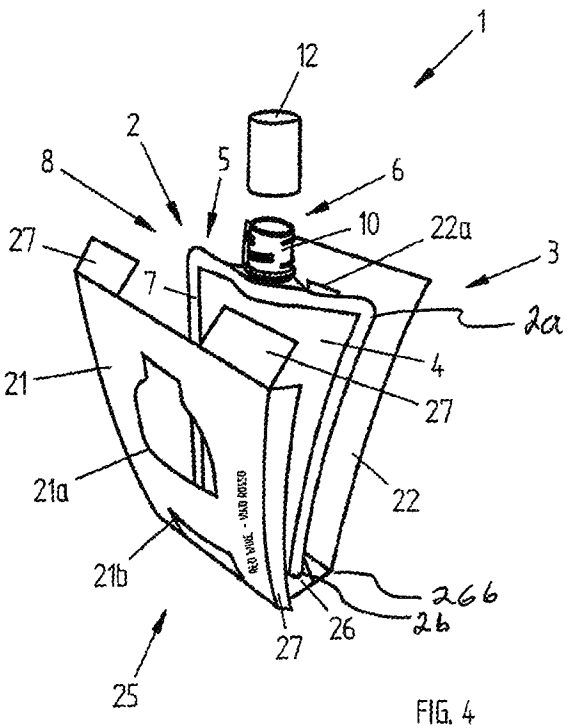
FIG. 4 shows the dispensing system of FIG. 3 in an intermediate step during its assembly.

The external lateral walls 21, 22, as shown in FIGS. 3 and 4 related to some steps of production of the dispensing system 1 of the invention, are preferably defined on a single very thin layer or sheet 25, on which the shaped openings

21*a*, 21*b*, 22*a*, 22*b* are provided. The external lateral walls 21, 22 are preferably joined by an intermediate connection area 26 suited to be arranged at the base of the container 2 during production. The intermediate connection area 26 preferably, but not necessarily follows the external profile of the base of the container 2. The intermediate connection area 26, in any case, advantageously provides the dispensing system 1 with a supporting base that guarantees its stability when the system 1 is positioned on a supporting surface. The stability offered by the intermediate connection area 26 will be guaranteed independently of the shape of the container 2 and of its base. This base can, for example, be constituted even by a simple edge, for example like a continuation of the heat-sealed edge 7.

During production of the dispensing system 1, the external lateral walls 21, 22 of the covering element 3 are rotated with respect to the intermediate connection area 26, as shown in FIG. 4, and therefore in the successive closing step the external lateral walls 21, 22 are joined to each other. The rotation preferably forms folds 26*a* and 26*b* via folding the covering element 3 to form external lateral walls 21 and 22 relative to the intermediate connection area 26.

In a preferred embodiment of the invention, connection means are provided between the external lateral walls 21, 22 of the covering element 3 and the lateral walls 4, 5 of the container 2, for example an adhesive substance and/or fixing, means. Advantageously, the mutual adhesion of the respective contact surfaces is guaranteed.

In a preferred embodiment, the external lateral walls 21, 22 of the covering element 3 are mutually and irreversibly joined. For example, for the embodiment illustrated herein, the periphery of one surface 21 of the two lateral surfaces 21, 22 of the covering element 3 is provided, preferably always in a single piece, with folding edges 27 that in the final closing step of the production process are fixed to the periphery of the other lateral surface 22.

Preferably, the fixing operation is performed using a bonding substance spread at the level of the folding edges 27.

In variant embodiments of the invention, however, the fixing operation can be performed in a different way, for example using different fixing means, for example mechanical fixing means such as clips or screws, or with different technologies, for example through heat sealing (obviously, provided that the material of which the lateral surfaces 21, 22 is made allows the use of said technology, for example if a plastic material is used).

In a preferred alternative embodiment, however, the external lateral walls can be mutually joined in a reversible manner, meaning that they can be mutually opened and closed as desired.

Figure 4A:
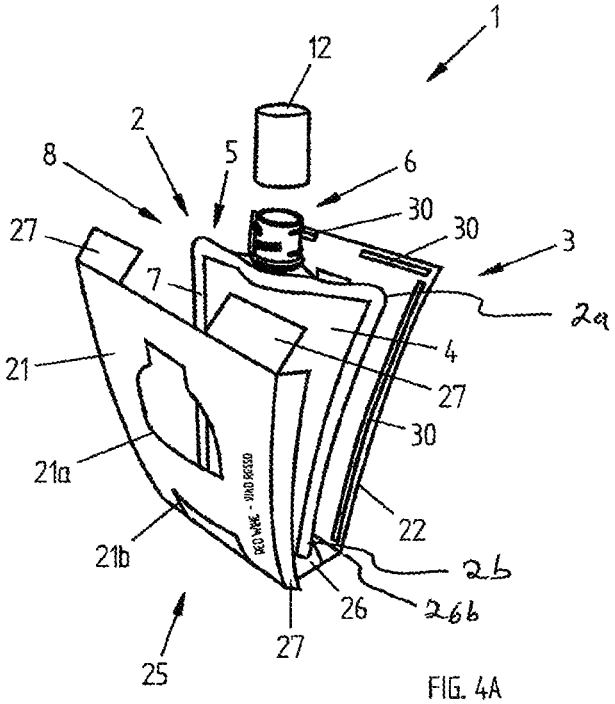
FIG. 4A shows an intermediate step of the assembly of a variant embodiment of the dispensing system of the invention.
Figure 5:
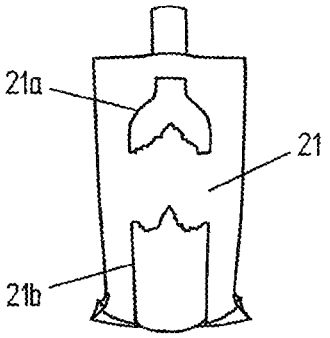
FIGS. 5 to 13 show different front views of variant embodiments of the dispensing system of FIG. 1.
Figure 6:
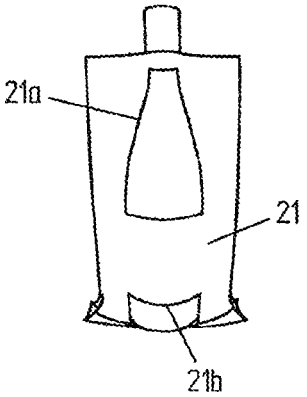
Figure 7:
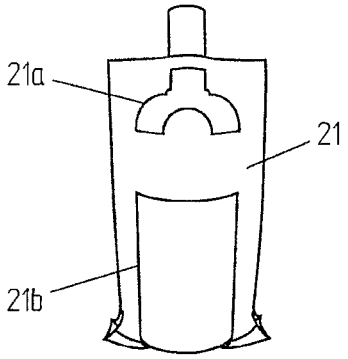
Figure 8:
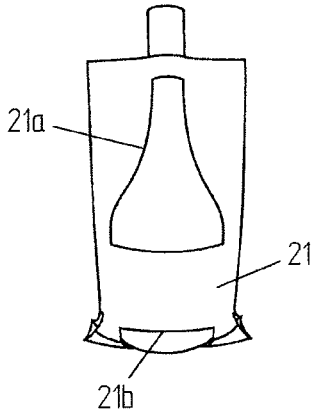
Figure 9:
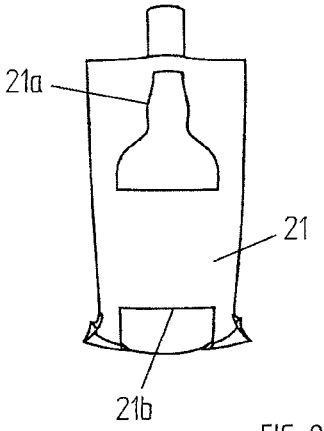
Figure 10:
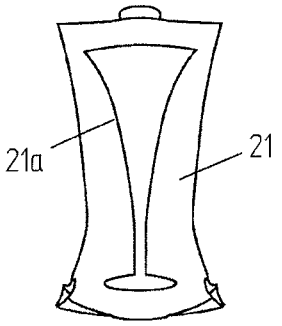

For example, with reference to the variant embodiment of FIG. 4A, the folding edges 27 of the first lateral surface 21 of the covering element 3 can be inserted through interference in corresponding through openings or slits 30 defined in the second lateral surface 22. In case of need, the folding edges 27 can be extracted from the corresponding slits 30 in order to allow the lateral surfaces 21, 22 to be separated from each other.

In variant embodiments, the reversible fixing means can be made in a different manner, for example using of snap-in fixing means.

The use of reversible fixing means becomes particularly important in a variant embodiment of the dispensing system of the invention in which the covering element 3 can be a reusable element, while the flexible container 2 can even be of the disposable type and suited to be used for a limited lapse of time, until it wears out, after which it will be advantageously replaced with a new flexible container inserted in the same covering element 3. In this case, therefore, the flexible container 2 preferably constitutes a spare part of the dispensing system 1.

As already mentioned above, the external lateral walls 21, 22, as well as the closing edges 27, are preferably defined on a single layer 25, which improves its production times and/or costs, as well as packaging times.

In variant embodiments of the invention, however, the covering element can be defined by several parts that can be conveniently connected to one another.

In variant embodiments, furthermore, the shape of the external lateral walls, and therefore also of the covering element, can be of a different type and properly selected by the manufacturer, as shown for example in FIGS. 15 to 19. For example, the container may comprise several lateral surfaces, mixtilinear or not, or even comprise only one lateral surface, for example a cylindrical surface.

As regards the material from which the covering element 3 is made, different options may be available, even depending on the actual method of use of the dispensing system 1.

In fact, in a preferred embodiment of the invention also the covering element is made of a non-rigid material, that is, a collapsible and/or deformable material. In the embodiment illustrated and described herein, the covering element 3, and in particular the entire sheet-like layer 25 that makes it up, is made from a collapsible and/or deformable material. The external pressure exerted on the external lateral walls 21, 22 of the covering element 3, for example the pressure of a hand as indicatively shown in FIG. 2, causes the collapse/deformation of one or both of the external lateral walls 21, 22 of the covering element 3 and in turn the collapse/deformation of the external lateral walls 4, 5 of the container 2, with consequent reduction of the inner volume V and outflow of the product W, as described above.

More preferably, the collapsible and/or deformable material that constitutes the covering element substantially returns to its original shape when the hand stops exerting pressure.

In variant embodiments, the covering element may comprise only one partially flexible part that can be collapsed/deformed when subjected to external pressure, for example exerted by a hand, to cause the product to be dispensed.

According to the above, it should be noted that the flexibility of the container 2 and/or of the covering element 3 allows the desired collapse/deformation and thus allows the product W contained therein to be dispensed, even with the dispensing system 1 in the vertical position and with the dispensing opening 6 facing upwards. It is evident, however, that the product W can in any case be dispensed even by making it flow downwards, or by pouring it through the dispensing opening 6 in the case where the dispensing system 1 is inclined and/or rotated.

The covering element is preferably made of a paper-based, synthetic, polymeric, textile, wooden, metallic material or a combination of several different materials etc.

In a preferred embodiment, the selected material is a paper-based material, a sheet, which favours the production and assembly steps. Preferably, the openings are made through a die-cutting operation and the folding and gluing operations are performed in a quick and simple manner, even automatically in a production system.

In an alternative embodiment of the invention, the covering element is preferably made of a rigid material. In this embodiment and according to a further advantageous aspect, the presence of one or more openings in one or more walls of the covering element creates an access way for the user, who for example can insert one or more fingers into it to exert pressure on the external lateral walls of the container and thus cause the collapse/deformation necessary for dispensing the product W, as previously described.

In this case, the external shape of the covering element remains unchanged during use of the dispensing system, with evident advantages when it comes to maintaining the desired stability and aesthetic appearance.

A further advantageous aspect of the invention derives from the presence of the covering element 3 in the dispensing system 1, wherein said covering element 3 is made separately from the container 2 that in turn, to advantage, is produced and filled by means of standard and quick processes, preferably in series.

The covering element 3, the material of which is conveniently selected according to that which has been explained above, can be easily customized by applying specific graphic elements, such as information on the origin or composition of the product and/or brands and/or logos and/or instructions for use, depending on the needs of the manufacturer and on possible obligations to be met for marketing purposes.

Advantageously, even after successive dispensing operations and independently of the shape assumed by the container 2 as it becomes emptier and emptier, the graphic elements on the outside of the covering element 3 remain perfectly identifiable and/or readable.

Furthermore, the material of the covering element 3 can be selected also based on the type of print that will be used for said graphic elements. Therefore, it will be possible to choose the printing technique that offers the most convenient costs and/or times. Therefore, there is no need to apply graphic elements directly to the container, as required by the known art, which on the other hand involves high costs due to the material typically used for the container. The selection of the material of the container, in fact, is mainly related to the type of product that will be contained therein and therefore must have determined characteristics that condition the selection of the material to the preservation of the product contained therein, for example, in particular, in the case where the product is a drink. The materials selected in this way, therefore, typically are not the most suitable materials for printing, which are rather expensive.

Still advantageously, the three-dimensional shape of the covering element can be specifically selected in order to improve its ergonomic characteristics. The dispensing system is more comfortable to hold, handle and use compared to the container alone.

Furthermore, the three-dimensional shape of the covering element can facilitate the dispensing system storage operations.

While in the preferred embodiments illustrated and described above there are four shaped openings 21*a*, 21*b*, 22*a*, 22*b*, that is, two for each lateral wall of the covering element, it should be noted that in variant embodiments the number, shape and position of said openings can be different, depending in particular on the desired final effect. By way of example, FIGS. 5 to 13 show possible variant embodiments that highlight this aspect.

FIGS. 5 to 9 preferably show a container element on whose external lateral surface 21, and possibly even on its opposite lateral surface not visible in the figures, there are two shaped openings 21*a*, 21*b* that give the dispensing system of the invention the generic aspect of a bottle.

Figure 11:
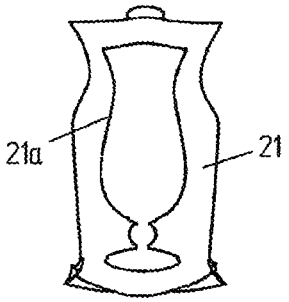
Figure 12:
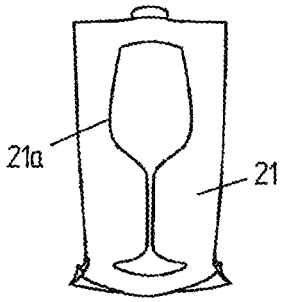

FIGS. 11 and 12 preferably show a container element on whose external lateral surface 21, and possibly even on its opposite lateral surface not visible in the figures, there is only one shaped opening 21*a* that gives the dispensing system of the invention the generic aspect of a glass or a cup.

Figure 13:
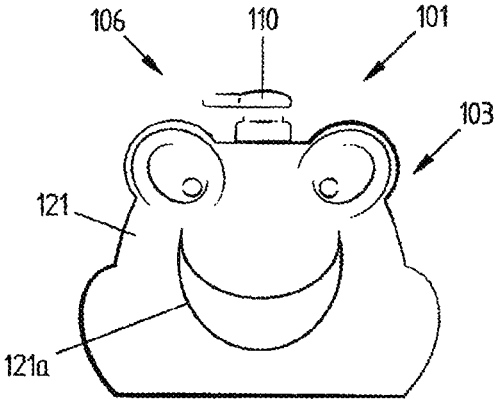
Figure 14:
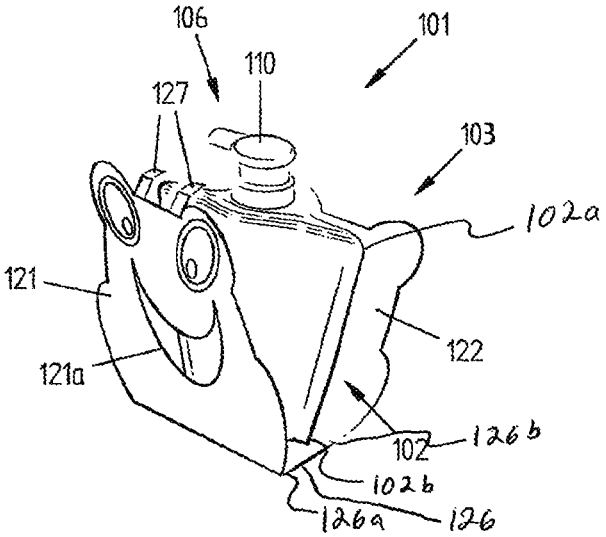
FIG. 14 shows a partially exploded view of the dispensing system of FIG. 13, FIGS. 15 to 20 show different axonometric views of variant embodiments of the dispensing system of FIG. 1.

FIG. 13 shows a dispensing device 101, in which the flexible container 102, having a top end 102*a* and a bottom end 102*b*, is particularly suited to contain a detergent that can be dispensed through a dispensing opening 106 provided with a dispensing spout 110.

The covering element 103 comprises two properly shaped lateral surfaces 121, 122, preferably coloured, which provide a specific aesthetic appearance, in the case at hand the face of a frog. On one surface 121 of said two external lateral surfaces 121, 122 of the covering element 103 there is a shaped opening 121*a*. The shaped opening 121*a* follows the shape of the frog's smiling mouth.

In particular, the shaped opening 121*a* makes it possible to serve the function and/or obtain the advantages described above:

it allows the deformation of the flexible container 102, in particular if the two external lateral surfaces 121, 122 are rigid; it makes it possible to view the quantity of detergent still present inside the flexible container 102; it defines an essential eye-catching element from the aesthetic point of view, which is the frog's smiling mouth.

The covering element comprises an intermediate portion 126, a first lateral portion 121 and a second lateral portion 122, wherein the first lateral portion 121 is connected to the intermediate portion 126 via a first fold 126*a* and the second lateral portion 122 is connected to the intermediate portion 1125 via a second fold 126*b*.

Two folding edges 127 allow the external lateral surfaces 121, 122 of the covering element 103 to be mutually joined to each other.

FIGS. 15 to 18 show, by way of example, possible variant embodiments of the dispensing system 201 of the invention, in which, preferably, there are four external lateral surfaces 221, 222, 223 and 224 arranged in such a way as to form, more preferably, a covering element 203 in a substantially parallelepiped shape.

Shaped openings 221*a*, 221*b*, 222*a*, 222*b* are provided on at least two of said external lateral surfaces 221, 222, 223 and 224.

Figure 15:
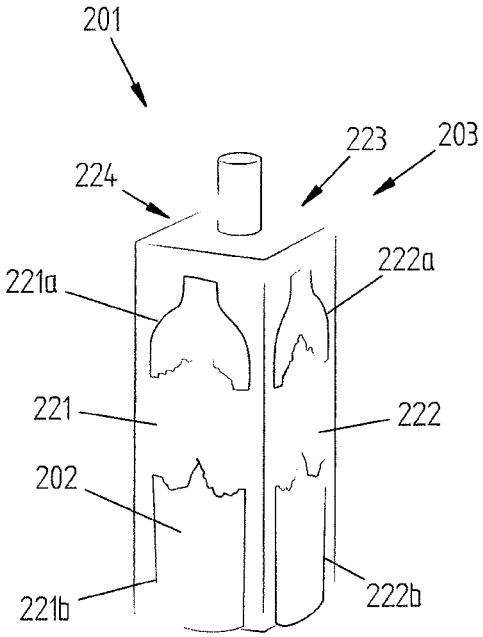
Figure 16:
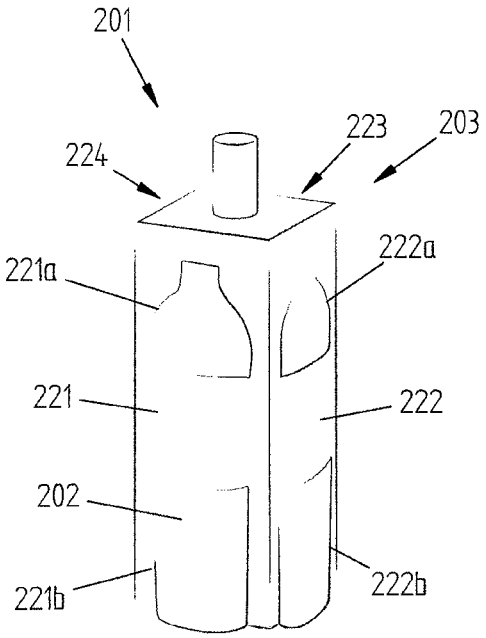
Figure 17:
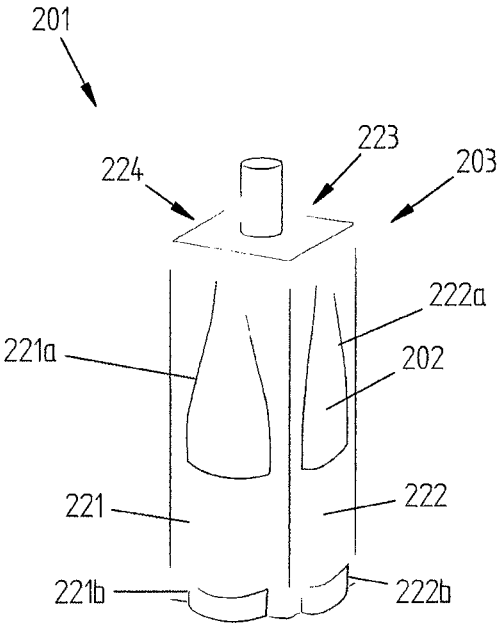
Figure 18:
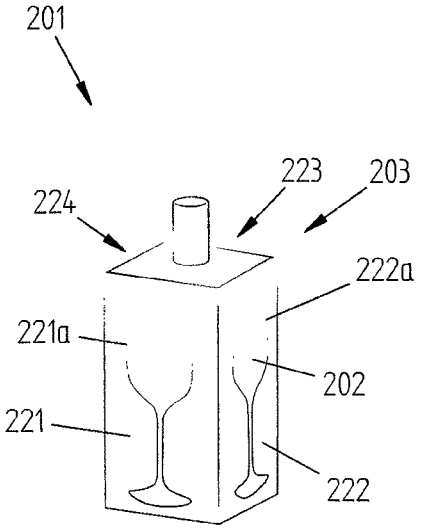

Preferably, in said embodiments the flexible container 202 has a substantially cylindrical shape and in some cases one or more portions of the flexible container 202 project with respect to the covering element 203 at the level of corresponding shaped openings 221*b*, 222*b*, as shown for example in FIGS. 15, 16 and 17.

Figure 19:
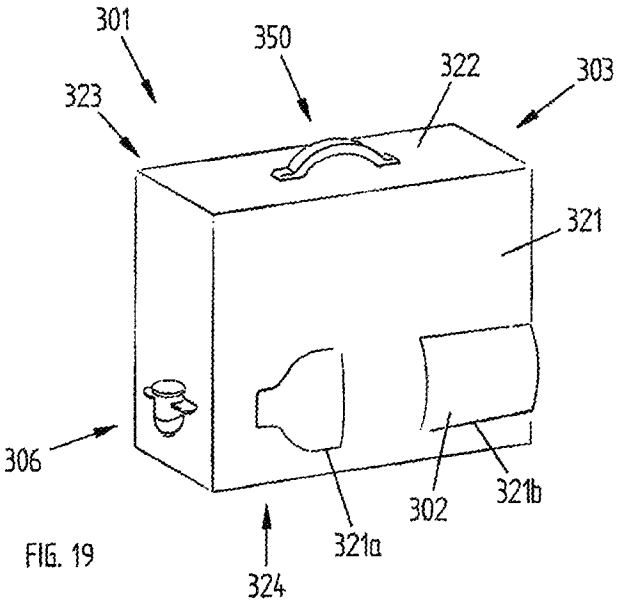

FIG. 19 shows a dispensing system 301 according to a variant embodiment of the invention (bag-in-box).

The dispensing system 301 preferably comprises four external lateral surfaces 321, 322, 323 and 324 arranged in such a way as to form, more preferably, a covering element 303 substantially in the shape of a parallelepiped.

On at least two of said external lateral surfaces 321, 323, only the first one of which is visible in the figure, there are shaped openings 321*a*, 321*b*.

Preferably, the flexible container 302 has a substantially cylindrical shape and projects from the covering element 303 at the level of the shaped openings 321*a*, 321*b*.

The flexible container 302 advantageously comprises a dispensing opening 306, provided with a corresponding opening valve.

The covering element 303 is also provided with lifting and/or transport means 350, for example a handle.

The handle 350 facilitates the lifting and transport operations related to the dispensing system 301.

Figure 20:
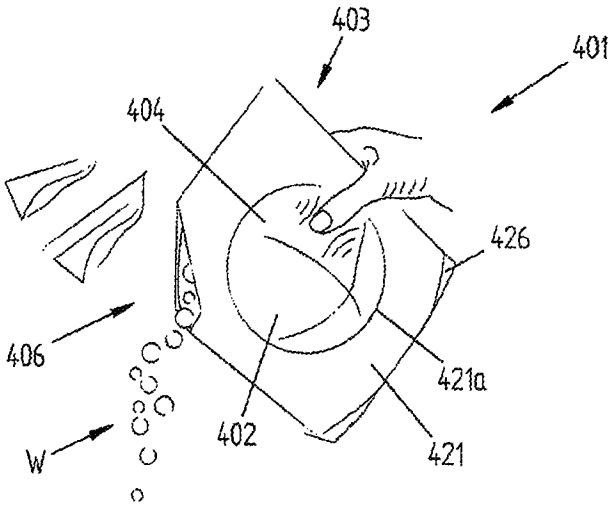
Figure 21:
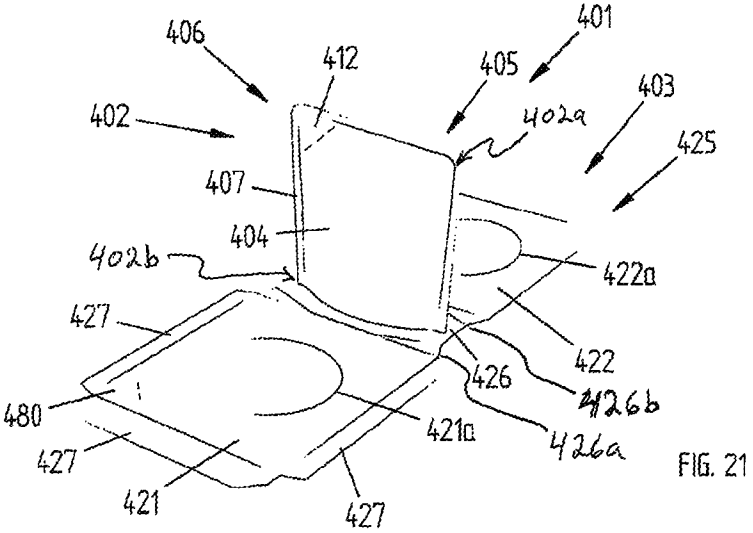
FIG. 21 shows a partially exploded view of the dispensing system of FIG. 20.

FIGS. 20 and 21 show a variant embodiment of the dispensing system 401 of the invention, wherein, preferably, the product W to be dispensed is in granular form (for example, a washing detergent in granules or detergent pods).

The dispensing, system 401 comprises a flexible container 402 and a covering element 403.

The flexible container 402 has a top end 402*a* and a bottom end 402*b* and it defines the inner volume V for containing the granular product W to be dispensed. The flexible container 402 is defined by external lateral walls 404, 405, preferably flexible over their entire geometric area.

The lateral walls 4, 5 that define said volume V are preferably made of a film in aplastic or plasticized material, if necessary heat-sealed along a closing edge 407.

An angle of the container 402 is provided with an opening 406 for dispensing the product W. The dispensing opening 406 is obtained by removing an angular portion 412 of the container 402.

The covering element 403 preferably comprises two external lateral walls 421, 422 suited to be arranged outside the external lateral walls 404, 405 of the container 402. The external lateral walls 421, 422 are joined to intermediate portion (26) via folds 426*a* and 426*b*, respectively.

On the external lateral walls 421, 422 of the covering element 403 there are two corresponding circular openings 421*a*, 422*a*.

The external lateral walls 421, 422 are preferably defined on a single very thin layer or sheet 425, on which the shaped openings 421*a*, 422*a* are obtained. The external lateral walls 421, 422 are preferably joined by an intermediate connection area 426 suited to be arranged at the base of the container 402 during the production step.

The intermediate connection area 426 provides the dispensing system 401 with a supporting base that guarantees its stability when the system 401 is positioned on a supporting surface.

The external lateral walls 421, 224 of the covering element 403 are preferably joined to each other through folding edges 427, for example using a bonding substance.

In order to allow the removal of the angular portion 412 of the container 402, also the covering element 403 is provided with a removable area 480 in the corresponding angle.

It has thus been shown that the present invention allows the set objects to be achieved. In particular, it makes it possible to provide a dispensing system for flexible containers that allows an easy and economical customization intended to provide the system with a high aesthetic value and/or improved ergonomic features compared to the systems of the known type.

While the present invention has been described with reference to the particular embodiments illustrated in the figures, it should be noted that the present invention is not limited to the particular embodiments illustrated and described herein; on the contrary, further variants of the embodiments described herein fall within the scope of the present invention, which is defined in the claims.

The invention claimed is:

1. A dispensing system comprising:

(a) a flexible container (2) comprising
- a top end (2*a*),
- a bottom end (2*b*),
- at least one lateral wall (4,5) between the top end (2*a*) and the bottom end (2*b*) defining a volume for a dispensable product having a collapsible and/or deformable portion between the top end (2*a*) and the bottom end (2*b*) capable of reducing the volume when an inward force is applied to the collapsible and/or deformable portion, and
- a closable opening (6) for dispensing a product located proximal to the top end (2*a*) and (b) a cover (3) for the flexible container (2) comprising:
- an intermediate portion (26) located below the bottom end (2*b*) of the flexible container (2) having a first fold (26*a*) and a second fold (26*b*) opposite the first fold (26*a*);
- a first lateral portion (21) extending from the first fold (26*a*) of the intermediate portion (26) to at least the top end (2*a*) of the flexible container (2); and
- a second lateral portion (22) extending from the second fold (26*b*) of the intermediate portion (26) to at least the top end (2*a*) of the flexible container (2);

wherein the intermediate portion (26), first lateral portion (21) and second lateral portion (22) are made from a single continuous sheet of paper-based material folded at the first fold (26*a*) and the second fold (26*b*) to form the intermediate portion (26), first lateral portion (21) and second lateral portion (22), wherein the single continuous sheet of paper-based material extends from the first lateral portion (21) to the second lateral portion (22) via the first fold (26*a*), the intermediate portion (26) and the second fold (26*a*) such that the single continuous sheet of paper-based material extends from, and including, the first fold (26*a*) to, and including, the second fold (26*b*) via the intermediate portion (26);

the flexible container (2) is located between the first lateral portion (21) and the second lateral portion (22) such that the bottom end (2*b*) of the flexible container (2) is proximal to the intermediate portion (26); and the first fold (26*a*) and the second fold (26*b*) are capable of supporting the cover (3) in an upright position when the dispensing system is placed on a horizontal surface.

2. The dispensing system according to claim 1, wherein at least one of the first lateral portion (21) and the second lateral portion (22) has a shaped opening (21*a*, 22*a*) exposing at least a portion of the collapsible and/or deformable portion of the at least one lateral wall (4,5) of the flexible container (2) for applying an inward pressure directly to the collapsible and/or deformable portion.

3. The dispensing system according to claim 2, wherein the flexible container (2) is capable of inwardly deforming from a first shape to a second shape in response to an inward force to reduce the volume in the flexible container (2) and returning to the first shape when the inward force is removed.

4. The dispensing system according to claim 1, wherein the first lateral portion (21) and the second lateral portion (22) each comprises at least one collapsible and/or deformable portion adapted to be deformed by an external pressure exerted by a user so as to apply an inward force on the flexible container (2) for dispensing a product from the flexible container (2).

5. The dispensing system according to claim 4, wherein the flexible container (2) is capable of inwardly deforming from a first shape to a second shape in response to an inward force to reduce the volume in the flexible container (2) and returning to the first shape when the inward force is removed.

6. The dispensing system according to claim 1, wherein the first lateral portion (21) has a shaped opening (21*a*) and the second lateral portion (22) has a shaped opening (22*a*), wherein each shaped opening (21*a*, 22*a*) exposes at least a portion of the collapsible and/or deformable portion of the at least one lateral wall (4,5) of the flexible container (2) for applying an inward pressure directly to the collapsible and/or deformable portion.

7. The dispensing system according to claim 6, wherein the at least one lateral wall of the flexible container (2) comprises a first lateral wall (4) and a second lateral wall (5) opposite to, and joined with, the first lateral wall (4), wherein the collapsible and/or deformable portion is comprised in each of the first lateral wall (4) and the second lateral wall (5).

8. The dispensing system according to claim 1, wherein the first lateral portion (21) and the second lateral portion (22) are attached to each other proximal to the top end (2*a*) of the flexible container (2).

9. The dispensing system according to claim 8, wherein the first lateral portion (21) and the second lateral portion (22) are attached to each other by bonding them to each other.

10. The dispensing system according to claim 8, wherein the first lateral portion (21) and/or the second lateral portion (22) comprise(s) at least one closing edge (27) proximal to the top end (2*a*) of the flexible container (2) for attaching the first lateral portion (21) to the second lateral portion (22).

11. The dispensing system according to claim 10, wherein the closable opening (6) extends from the top end (2*a*) of the flexible container (2) to a location beyond the first lateral portion (21) and the second lateral portion (22).

12. The dispensing system according to claim 1, wherein the closable opening (6) extends from the top end (2*a*) of the flexible container (2) to a location beyond the first lateral portion (21) and the second lateral portion (22).

13. The dispensing system according to claim 12, wherein the first lateral portion (21) and the second lateral portion (22) are attached to each other via a pair of closing edges (27) proximal to the top end (2*a*) of the flexible container (2) flanking the closable opening (6).

14. The dispensing system according to claim 1, wherein the flexible container (2) is capable of inwardly deforming from a first shape to a second shape in response to an inward force to reduce the volume in the flexible container (2) and returning to the first shape when the inward force is removed.

* * * * *